US006701805B2

(12) United States Patent
Souder et al.

(10) Patent No.: US 6,701,805 B2
(45) Date of Patent: Mar. 9, 2004

(54) STONE WORKING TOOL HAVING MULTIPLE STRIKING EDGES ON REVERSIBLE-REPLACEABLE PLATES

(76) Inventors: Richard B. Souder, 192 Fretz Rd., Telford, PA (US) 18969; William E. Baum, 1404 Broad St., Perkasie, PA (US) 18944

( * ) Notice: Subject to any disclaimer, the term of this patent is extended or adjusted under 35 U.S.C. 154(b) by 0 days.

(21) Appl. No.: 10/099,359

(22) Filed: Mar. 15, 2002

(65) Prior Publication Data

US 2003/0172779 A1 Sep. 18, 2003

(51) Int. Cl.[7] ..... B25D 1/00

(52) U.S. Cl. ..... 81/26; 81/20; 81/25; 254/18; 254/19; 125/23; 125/41

(58) Field of Search ..... 81/20, 25, 26, 81/DIG. 12; 254/18, 19; 125/23, 41, 45

(56) References Cited

U.S. PATENT DOCUMENTS

| | | | | |
|---|---|---|---|---|
| 850,024 A | | 4/1907 | Lewis | |
| 2,067,751 A | | 1/1937 | Beegle | 306/20 |
| 2,570,691 A | | 10/1951 | Kindland | 145/36 |
| 2,763,172 A | * | 9/1956 | Richards | 81/25 |
| 3,019,827 A | | 2/1962 | Jeffery et al. | 145/36 |
| 3,042,092 A | | 7/1962 | Ekstrom | 145/36 |
| 3,129,737 A | | 4/1964 | Citroen | 145/29 |
| 3,211,198 A | * | 10/1965 | Glasgow | 81/19 |
| 4,047,278 A | * | 9/1977 | Kurata | 29/424 |
| 4,558,726 A | | 12/1985 | Clay | 819/25 |
| 4,753,137 A | | 6/1988 | Kennedy | 81/22 |
| 4,882,955 A | | 11/1989 | Savnik | 81/20 |
| 5,526,719 A | | 6/1996 | Chen | 819/25 |
| 5,546,832 A | | 8/1996 | Townsend | 81/25 |
| 5,735,630 A | | 4/1998 | Keathley et al. | 403/334 |
| 5,768,956 A | | 6/1998 | Coonrad | 81/20 |
| 5,860,334 A | | 1/1999 | Coonrad | 81/20 |
| 5,988,019 A | | 11/1999 | Coonrad | 81/20 |
| 6,131,488 A | | 10/2000 | Coonrad | 81/20 |
| 6,176,156 B1 | | 1/2001 | Coonrad | 81/20 |
| 6,250,181 B1 | | 6/2001 | Coonrad | 81/20 |
| 6,449,789 B1 | * | 9/2002 | Krass et al. | 7/143 |

FOREIGN PATENT DOCUMENTS

| | | | | |
|---|---|---|---|---|
| WO | WO9848978 | * | 4/1998 | B25D/1/00 |

* cited by examiner

*Primary Examiner*—Joseph J. Hail, III
*Assistant Examiner*—Alvin J. Grant
(74) *Attorney, Agent, or Firm*—Duane Morris LLP

(57) ABSTRACT

A stone hammer having a weighted head has detachably rotatable and reversible faceplates defining striking edges on opposite ends of the head. The edges of the faceplates define cutting edges for trimming stone and the like. As a striking edge becomes worn, another striking edge can be selected by repositioning the faceplate. A striking edge may be selected by rotating a faceplate, individually reversing a faceplate, replacing a faceplate, striking with an opposing end or different edge of the hammer, or any combination thereof. In one embodiment, the faceplates are attached by a symmetrical pattern of bolts disposed in the faceplates. A worn striking edge is replaced by unbolting the faceplate and either flipping the faceplate over, or replacing the worn faceplate with a new faceplate having fresh, sharp edges.

17 Claims, 11 Drawing Sheets

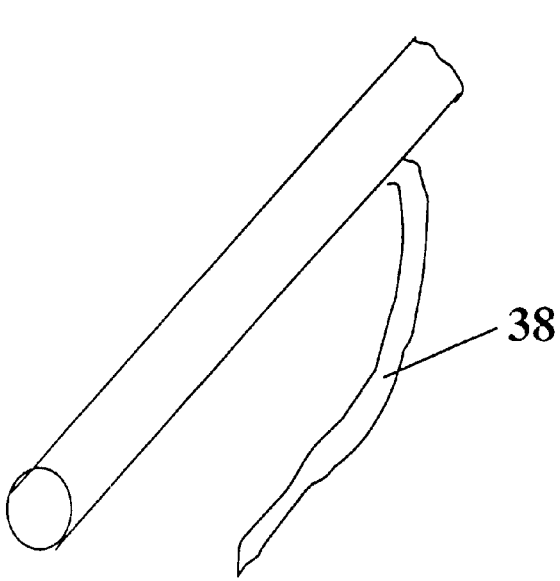
FIGURE 6C
FIGURE 6B
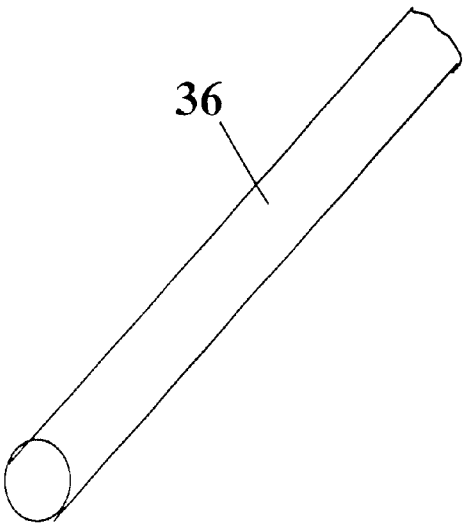
FIGURE 6A

STONE WORKING TOOL HAVING MULTIPLE STRIKING EDGES ON REVERSIBLE-REPLACEABLE PLATES

FIELD OF THE INVENTION

The invention relates to hand tools, and specifically concerns a hammer for shaping stone and masonry by manually striking the stone to break away material at the surface. Multiple working tool edges are provided by plates that are replaceably mounted, preferably on each of two opposite striking faces on the tool. Each plate can be re-oriented on the tool, for placing a fresh edge in a selected exposed position for use. Each plate also can be reversed for moving a fresh set of edges from a protected side to an exposed side of that plate.

BACKGROUND

Stone working hammers are used to trim natural stone, masonry, and the like (herein generally described as "stone"), for example to size pieces of stone or masonry so as to fit at a given place in a structure, or to normalise the size or shape of stones in a supply to be used for building or paving, etc. A stone working hammer for such a purpose generally comprises a striking head mounted on a handle, to be swung against the stone by the craftsman. At least the part that impacts the stone is advantageously made of a relatively durable material so that the tool has a reasonable service life, such as hardened steel.

For detail work, the striking head preferably has a sharply defined striking edge, thus concentrating the point of impact and permitting accurate cutting and trimming of the stone by controlled chipping away of material at selected edges. A striking edge that is sharply defined, however, is also inherently thin at its edge, and wears rapidly with repeated impact. The striking edge becomes rounded, and it is more difficult for the craftsman precisely to cut the stone because the force of the impact is less controllable and localised.

It will be appreciated that stone working hammers are thus unlike many familiar sorts of hammers and mallets, such as claw hammers for driving nails, ball peen hammers for metal working, etc., because the edge of the striking face of the stone working hammer is critical, not the mass of the hammer along its midline. When the striking edge of a stone hammer becomes rounded and worn, the head of the hammer must be replaced or sharpened by grinding away material down to a new discrete cutting edge.

There are disadvantages associated with sharpening stone hammers. Sharpening procedures may be relatively complex, costly and time consuming. The process is comparable to the steps needed to make a new tool from scratch. A stone hammer is typically sent to a blacksmith to be sharpened. The blacksmith heats the hammer to remove its hardening, and then reshapes the hammer to restore its sharp edges. It is often necessary to re-treat the hammer to harden its working surfaces, for example to nitride, or temper by heat treatment and quenching. A hammer needing sharpening could alternatively be sent to a machinist to grind or mill away material up to planes that meet at the cutting edge. However, the hammer will lose its hardening, thus limiting its usefulness as a stone working tool. Also, grinding the hammer removes steel, which limits the useful lifetime of the hammer.

While a worn hammer is being refurbished and sharpened, it is out of service. Given the limited number of blacksmiths in an area, it is conceivable that hammers can be out of service for several months. Thus the stock of hammers kept available must be large enough to account for some of the hammers being out of service at any given time for sharpening.

It is also conceivable that the majority of the hammers owned by a stone cutting operation can be out of service at any given time. The striking edge of a stone hammer can be worn to an extent that it needs sharpening after one full day's use. If the operation is such that it takes the machinist several days to sharpen and return worn stone hammers, then the inventory of stone hammers must be several times the number of users.

Stone cutting craftsmen tend to use their tools in a characteristic way. For example a right-handed cutter is likely to wear one edge of the cutting face of a hammer more than another edge, that a left-handed cutter might be more prone to use. Even given that fact, a relatively large investment in a working inventory of stone hammers may be needed. With regular use there is a constant workload on the machinists who refurbish the hammers. After a few sharpening operations the tool is reduced by the trimming operations associated with sharpening and must be replaced. There is a need to reduce or eliminate the associated expense and effort by stone cutting operations to keep an available stock of stone hammers with fresh edges to use for stone cutting and trimming.

SUMMARY OF THE INVENTION

The invention meets this need by providing quickly, easily, and inexpensively replaced striking plates whose tooling faces and mounting define selectively deployed polygonal straight edges. Preferably, for example, the striking plates have a rectilinear shape and are mounted in a symmetrical manner whereby the plates are removably attachable to a tool head base part at any selected 90 degree increment. Thus a fresh edge on one side of the plate can be moved readily into a given position on the tool for use in cutting. The striking plates are reversible. The number of polygonal edges is thereby doubled. Furthermore, the tool itself preferably has opposite faces, again doubling the number of available edges. As a result, in a rectilinear cutting plate arrangement, as many as sixteen fresh cutting edges can be worn before the tool requires service, and such service can be quickly and conveniently accomplished by replacing the striking plates rather than refurbishing the tool as a whole.

Thus according to the invention, a manual stone hammer is provided with at least one polygonal faceplate, and preferably two opposite faceplates, both being individually reversible and thereby providing selectively available striking edges in four times the number of faces of the polygon.

BRIEF DESCRIPTION OF THE DRAWINGS

The above and other advantages and features of the present invention will be better understood from the following detailed description of the preferred embodiments of the invention, which is provided in connection with the accompanying drawings. The various features of the drawings may not be to scale. Included in the drawing are the following figures:

FIG. 6A is an illustration of an exemplary handle defining an elongated shaft for attachment to the tool head;

FIG. 6B is an illustration of an exemplary handle, further comprising a finger guard;

FIG. 6C is an illustration of an exemplary handle contoured to fit a hand;

DETAILED DESCRIPTION OF THE PREFERRED EMBODIMENTS

Figure 1:
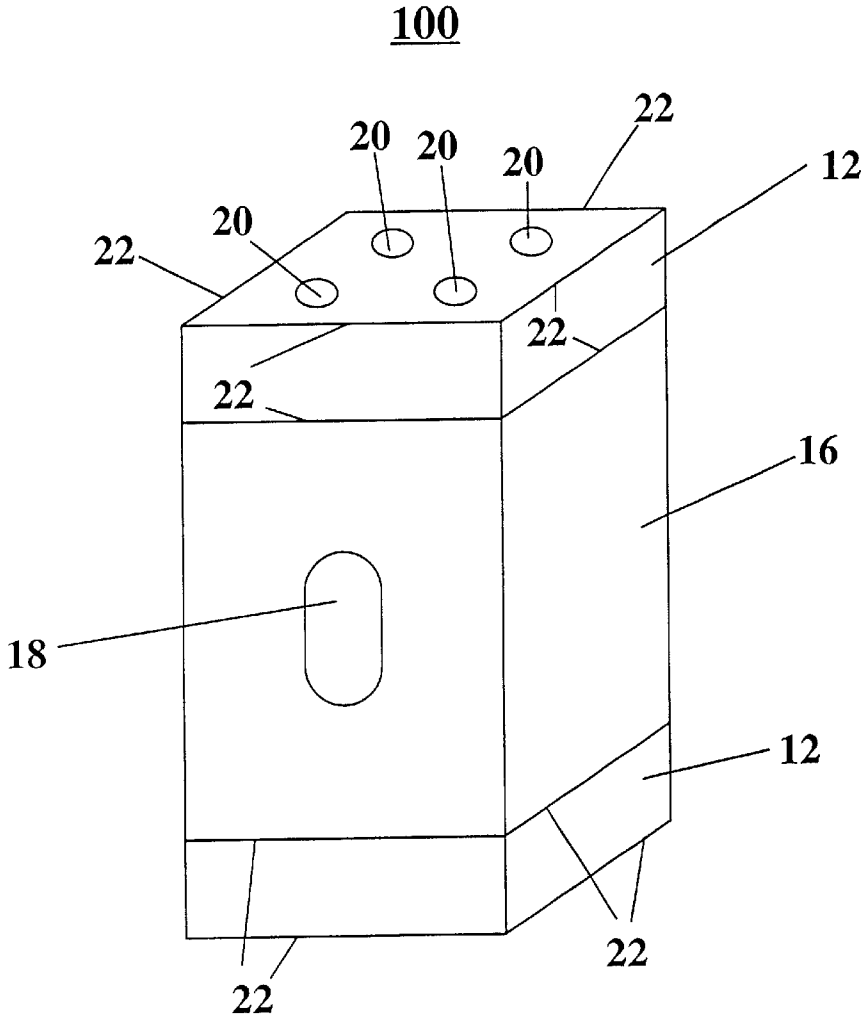
FIG. 1 is an isometric view of an exemplary embodiment of a stone hammer in accordance with the invention.
Figure 2B:
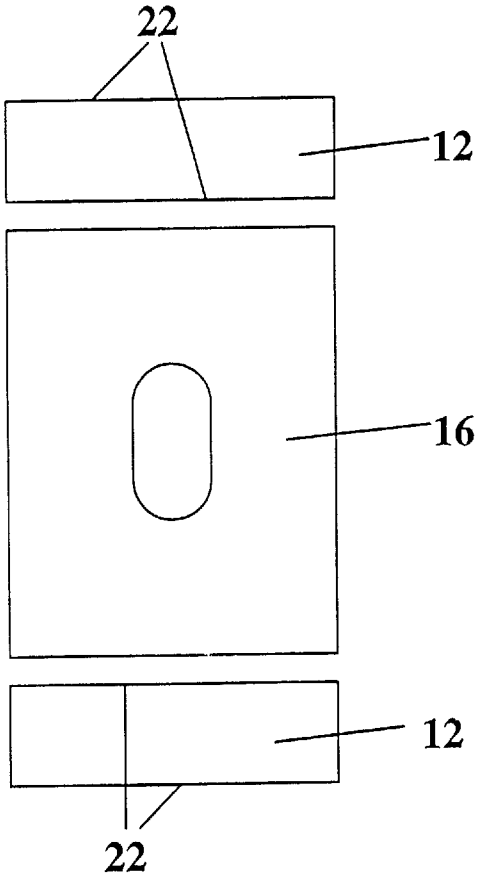
FIG. 2B is an exploded illustration of the embodiment of FIG. 2A.
Figure 2A:
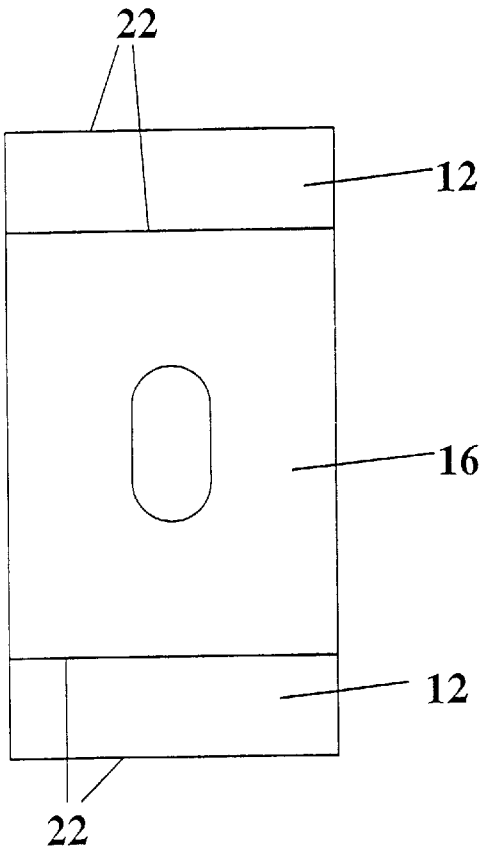
FIG. 2A is a front elevation view of an exemplary embodiment of a stone hammer in accordance with the invention.

FIG. 1 is a three-dimensional view of a stone hammer 100 having detachably affixed faceplates 12, which can be oriented in certain different arrangements to present different edges for use in stone cutting. Stone hammer 100 comprises at least one faceplate 12 defining the edges, and a weight-bearing head 16 on which the faceplate is attached at a selected orientation. FIG. 2A is a front view of the stone hammer 100, and FIG. 2B is an exploded front view of stone hammer 100 showing the faceplates 12 separated from the head 16. The faceplates 12 are polygonal, for example rectilinear as shown. Each side of the polygon providing a distinct edge on each of two opposite sides of faceplate 12.

Each faceplate 12 comprises a plurality of approximately right-angled striking edges 22 for trimming stone, masonry, and the like. Each faceplate 12 also comprises at least one opening 20 for attaching the faceplate 12 to the head 16. In one embodiment of stone hammer 100, head 16 defines an opening 18 for receiving a handle.

In use, a selected striking edge 22 of stone hammer 100 makes contact with a stone, or similar object, to be cut. Normally the user prefers a particular edge of the hammer 100, for example depending on whether the person is left handed or right handed, or for a particular habitual operation such as striking with an outer edge or a side edge. As any such selected striking edge 22 becomes worn, another striking edge 22 might be selected by reorienting the tool. However instead or in addition to the possibility of reorienting the tool, according to an inventive aspect, the faceplate 12 can be detached, re-oriented and re-attached with a fresher edge in the corresponding position. As described herein in detail, a striking edge may be selected by reversing a faceplate 12 or by rotating a faceplate 12, by replacing a faceplate 12 with a new faceplate, and by reorienting the whole tool manually for striking with a different edge of the stone hammer 100, or by any combination thereof.

Figure 3:
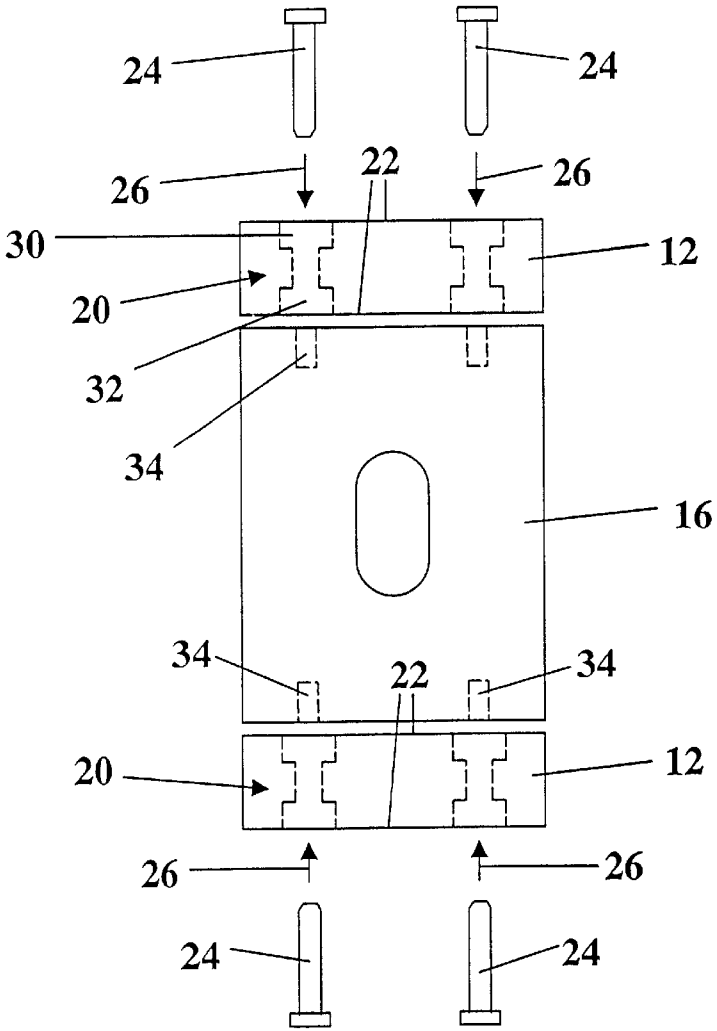
FIG. 3 is a exploded front elevation of an exemplary embodiment of a stone hammer according to the invention, wherein bored and countersunk openings and threaded portions are shown in broken lines.

FIG. 3 is a front view of stone hammer 100, showing faceplates 12 separated from head 16, and showing by broken lines the openings 20 and recessed portions 34 that are spaced inwardly from the surface. In one embodiment of the stone hammer 100, faceplates 12 are attachable to head 16 by bolts 24. In this embodiment, bolts 24 are threaded, and are positioned within openings 20 and threaded into threaded recessed portions 34. Each opening 20 comprises opposing countersunk or counterbored portions 30 and 32 that serve to protect the heads of bolts 24 by placing them below flush with the surface of the hammer 100.

A counterbore as shown is provided on both ends of each fastener hole, to facilitate reversal of the faceplate 12. As shown in FIG. 3, a countersunk portion 32 is positioned adjacent head 16, and accordingly countersunk portion 30 is positioned opposite head 16.

Each faceplate 12 is symmetric, at least about a plane parallel to the mating surface of faceplate 12 and head 16, to permit reversing. That is, each rectilinear faceplate 12 in the embodiment shown is individually reversible, and upon being reversed, countersunk portion 30 adjacent head 16 exchanges positions with countersunk portion 32 opposite head 16. The fastener holes still align with the threaded holes in the tool head. As also discussed, the fastener holes also can be equiangularly distributed such that the faceplates 12 can be rotated as opposed to reversed, to a position at which the holes again align. In either case, a result is to bring a fresh striking edge 22 into a given edge position.

Rotating a faceplate moves the worn edge to a different position but it remains on the exposed side of the faceplate 12. Reversing a faceplate 12 provides a new set of striking edges 22 for selection, four being available in the square or rectangular shape shown. To reverse a faceplate 12, faceplate 12 is detached from head 16, the orientation of faceplate 12 is reversed (e.g, flipped over), and faceplate 12 is attached to head 16. Detachment and attachment may be accomplished by simply unthreading and threading bolts 24, respectively, out of and into threaded portions 34 through opening 20. Thus a user (e.g., a stone cutter) of the stone hammer 100, may select another striking edge 22 by individually reversing a faceplate 12.

Figure 4A:
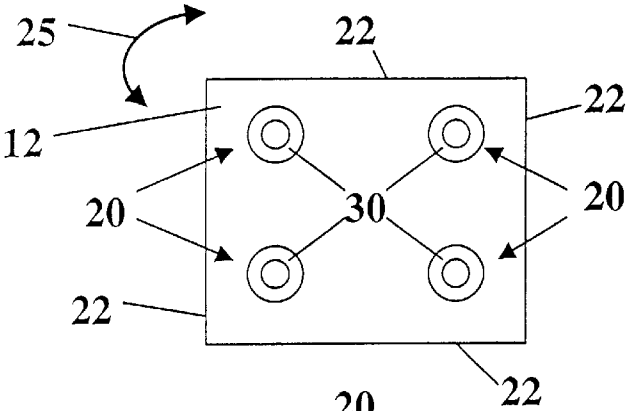
FIG. 4A is a top plan view of an exemplary embodiment of a rectilinear faceplate having four openings in accordance with the invention.
Figure 4B:
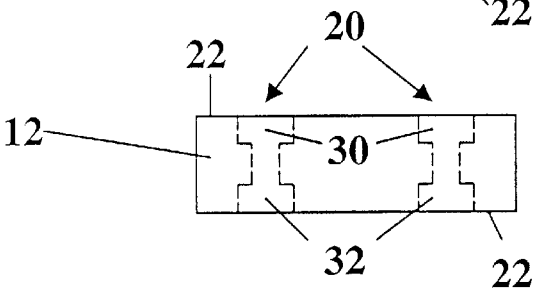
FIG. 4B is a front elevation view of an exemplary embodiment of the rectilinear faceplate of FIG. 4A.
Figure 4C:
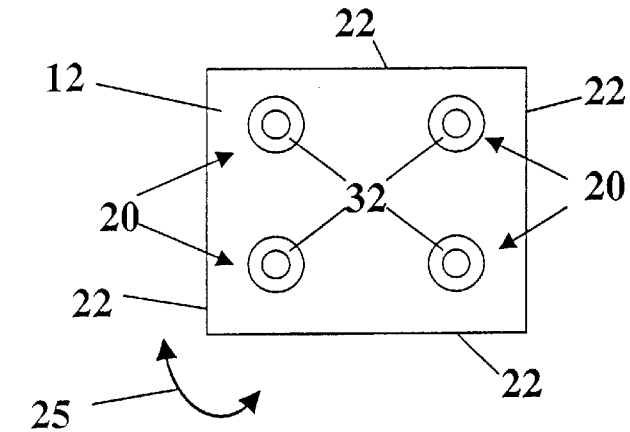
FIG. 4C is a bottom plan view of the exemplary embodiment of FIGS. 4A and 4B.

In the preferred configuration shown, a different striking edge 22 is also selectable for a given position on the tool by rotating the faceplate 12. FIGS. 4A, 4B, and 4C are top, front, and bottom views, respectively of an exemplary rectilinear faceplate 12. As shown in FIGS. 4A, 4B, and 4C, rectilinear faceplate 12 comprises four symmetrically positioned openings 20. These symmetrically positioned openings 20 are positioned such that each faceplate 12 is symmetric and reversible about each of three orthogonal axes.

Accordingly, each faceplate 12 is rotateable in the directions shown by arrows 25. Each faceplate 12 is individually rotatable in two directions as indicated by arrows 25, in increments of 90 degrees. Each rectilinear faceplate 12 comprises four striking edges 22 on each of its two opposing sides. Thus, each faceplate 12 comprises eight striking edges. A stone hammer 100 comprising two faceplates 12, has 16 selectable striking edges 22. A striking edge 22 may be selected by any combination of reversing a faceplate 12, rotating a faceplate 12, and striking with an opposing side of the stone hammer 100. Also, a striking edge 22 may be selected by replacing the entire faceplate 12. This provides a number of ways to deploy a fresh striking edge 22. As a striking edge 22 becomes worn, the user of the stone hammer 100 has the option of selecting another striking edge 22 as described above (reverse faceplate, rotate faceplate, strike with opposing end of hammer), or replacing a faceplate 12 with a another faceplate 12.

A removed faceplate 12 may be discarded or sharpened for subsequent use. However, the structure of the faceplate is relatively uncomplicated, and it is possible to maintain a stock of faceplates much more easily than one can maintain a stock of complete hammers.

Figure 5A:
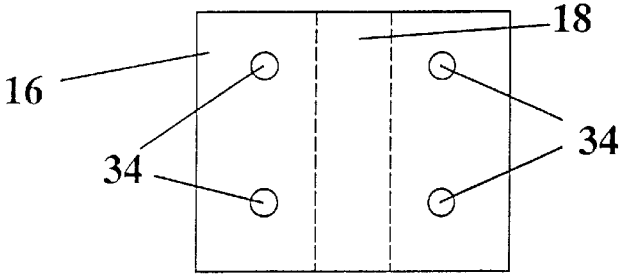
FIG. 5A is a top plan view of an exemplary tool head body according to the invention.
Figure 5B:
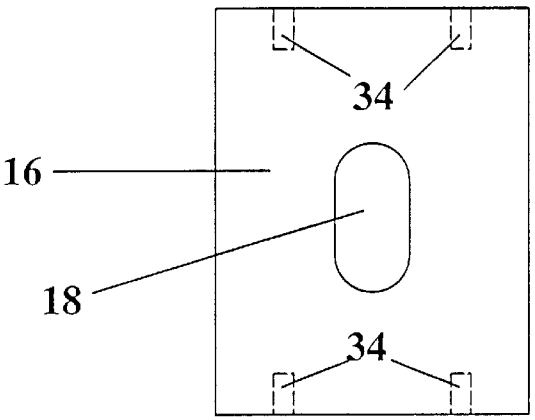
FIG. 5B is a front elevation view of the tool head body as shown in FIG. 5A.
Figure 5C:
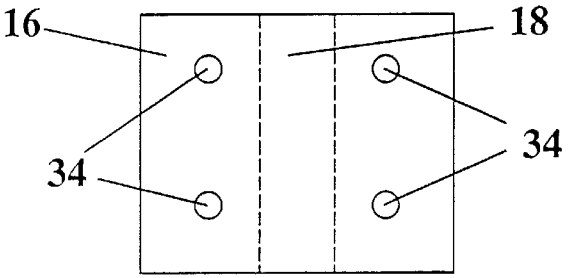
FIG. 5C is a bottom plan view of the tool head body of FIGS. 5A and 5B.

FIGS. 5A, 5B, and 5C are top, front, and bottom views, respectively of head 16 showing hidden views of recessed or counterbore portions 34 and opening 18. Recessed portions 34 are positioned in head 16 to align with the openings 20 in faceplates 12. Recessed portions 34 are positioned on opposite ends of head 16 as indicated by the top view (FIG. 5A) and bottom view (FIG. 5C) of head 16. Thus, head 16 is adapted to receive faceplates 12 at opposing ends of head 16.

The invention has the further advantage that the weight of head 16 can be selectable while using standard forms of faceplate 12. That is, a user may select a head 16 having a desired weight. Weights may range, inclusively, from 3 pounds to 20 pounds (e.g., full size sledgehammer), for example.

A lateral opening 18 is located approximately in the center of head 16 to allow attachment of a handle. The handle can be attached in a conventional manner, such as by slitting the end of a wooden handle and driving a wedge into the slit from the opposite side (not shown). An axial fastener also is possible, or a threaded handle portion that receives a nut on the side opposite from the handle shaft.

Although opening 18 is shown as a means for receiving a handle, other means are appropriate. Such other means include a handle permanently attached to the head 16, or a handle and head formed from a single structure (e.g., molded or cast). Head 16 may comprise various materials, such as metal, wood, plastic, fiberglass, ceramics, and combinations, thereof, for example.

Various handles are envisioned, such as the exemplary handles shown in FIGS. 6A, 6B, and 6C. According to a preferred aspect, however, the invention is apt for manual use as a hand tool. This is illustrated in the drawings with respect to handle configurations that are apt for manual gripping, for example, comprising a shaft 36, a finger guard 38, a contoured handle 39, or any combination thereof. The contoured handle 39 may have a covering contoured to fit a hand, or the contours may be formed in the handle.

Figures 7A, 7B, 7C, 7D:
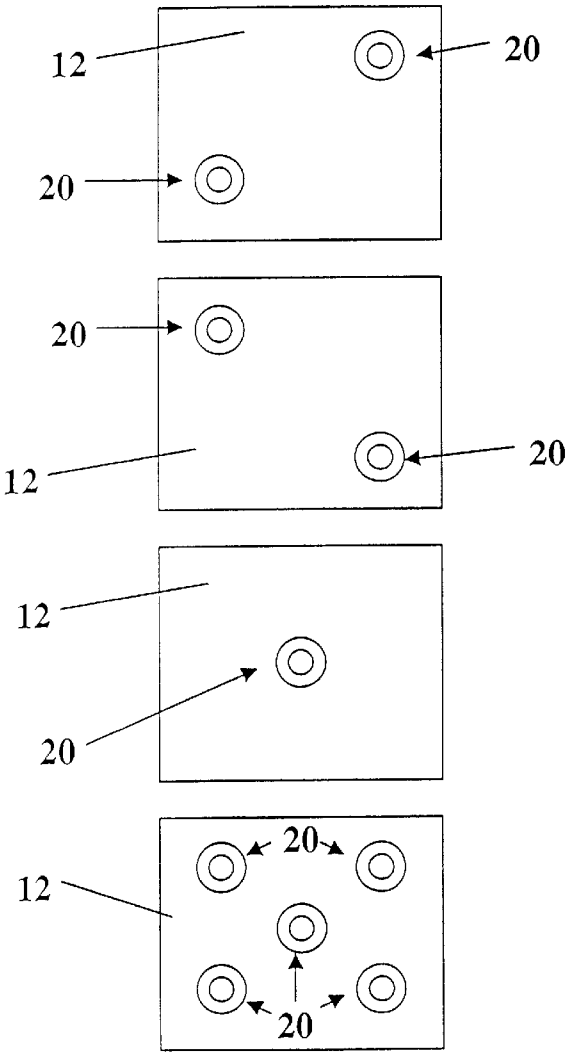
FIG. 7A is a top plan view of an alternative embodiment of a rectilinear faceplate in accordance with the invention, having two fastener openings defining a line of symmetry.
FIG. 7B is a bottom plan view of the embodiment of FIG. 7A.
FIG. 7C is a top plan view of a faceplate having a radially symmetric fastener pattern, in particular having one central fastener opening.
FIG. 7D is a top planar view of a radially symmetric fastener pattern in a quincunx array.

FIGS. 7A, 7B, 7C, and 7D are top views of various embodiments of faceplate 12 having various positions of openings 20. As shown in FIGS. 7A and 7B, openings 20 may be located at opposing corners of faceplate 12. To accommodate the configurations shown in FIGS. 7A and 7B, head 16 may maintain the configuration of recessed portions 34 as previously described, or alternatively head 16 may have only two threaded portions 34 on each end of head 16, aligned with the respective openings 20 as shown in FIGS. 7A and 7B. FIG. 7C shows a single opening 20 defined by faceplate 12. Accordingly, to accommodate this configuration, head 16 has an corresponding recessed portion 34 aligned with the single opening as shown in FIG. 7C. To accommodate the configuration shown in FIG. 7D, head 16 may comprise any of the previously described configurations of recessed portions 34, or any combination thereof.

Figure 8:
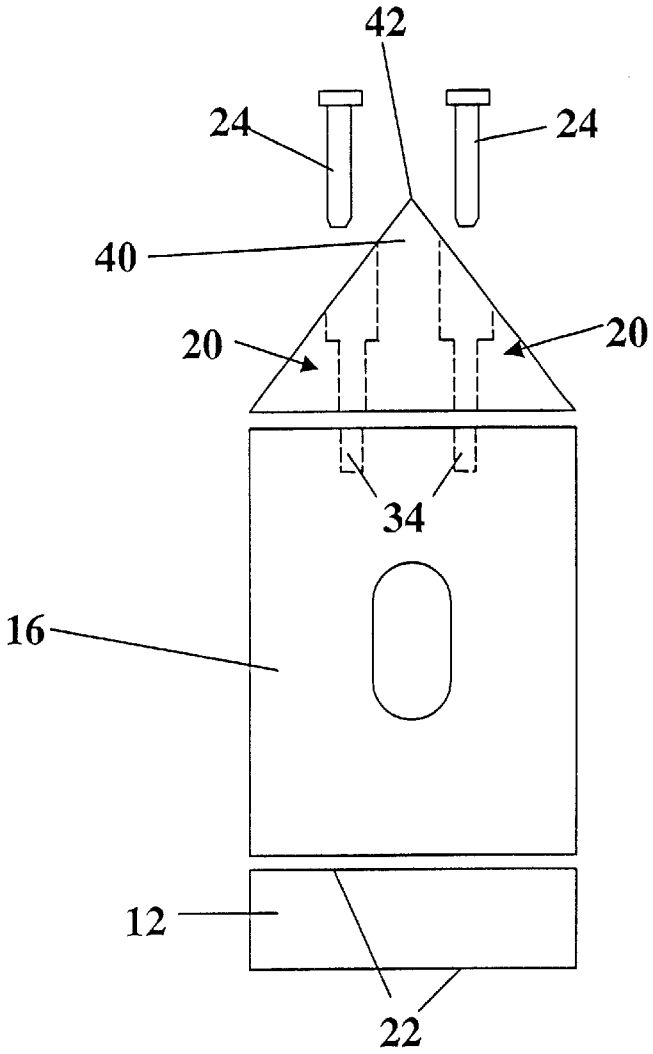
FIG. 8 is a front elevation exploded view of an embodiment of a stone hammer having a wedge shaped faceplate on one side and a rectilinear block faceplate on the opposite side.
Figures 9A, 9B, 9C, 9D:
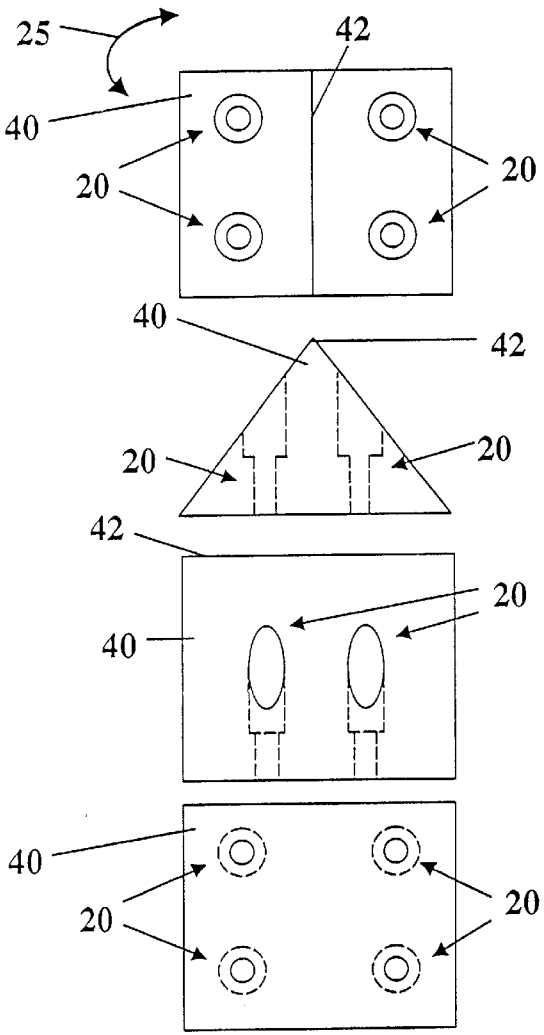
FIG. 9A is a top view of wedge shaped faceplate in accordance with an embodiment of the invention.
FIG. 9B is a front view of the wedge shaped faceplate.
FIG. 9C is a side elevation view of wedge shaped faceplate in accordance with an embodiment of the invention, showing fastener openings.
FIG. 9D is a bottom plan view of wedge shaped faceplate as in FIGS. 9A–9C.

FIG. 8 is a front view of a stone hammer comprising a wedge shaped faceplate 40. Wedge shaped faceplate 40 comprises a striking edge 42 that is central rather than at the lateral edge of the faceplate. The striking edge 42 of faceplate 40 is approximately perpendicular to the striking edge 22 of the more rectilinear faceplate 12. A stone hammer in accordance with the present invention may comprise any combination of wedge shaped faceplates 40 and rectilinear faceplates 12. In the exemplary embodiment shown, the stone hammer comprises one wedge shaped faceplate 40 and one rectilinear faceplate 12.

Various types of faceplates are envisioned. FIGS. 9A, 9B, 9C, and 9D are a top view, a front view, a side view, and a bottom view, respectively, of wedge shaped faceplate 40. As shown in FIGS. 9A, 9B, 9C, and 9D, wedge shaped faceplate 40 comprises openings 20 positioned similarly to the openings 20 as previously described herein with respect to rectilinear faceplate 12. Accordingly, faceplates 40 and faceplates 12 are interchangeable. The openings 20 in wedge shaped faceplate 40 are countersunk in the top portion of each opening. Furthermore, wedge shaped faceplate 40 may comprises any of the configurations having two or four openings 20 as previously described herein with respect to faceplate 12. Wedge shaped faceplate 40 is also rotateable in the directions indicated by arrow 25.

Figure 10A:
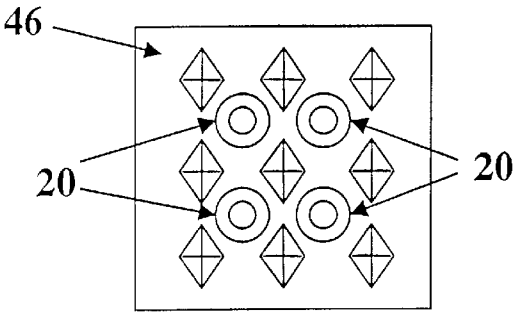
FIG. 10A is a top view of a bushing tool faceplate, in accordance with an embodiment of the present invention.
Figure 10B:
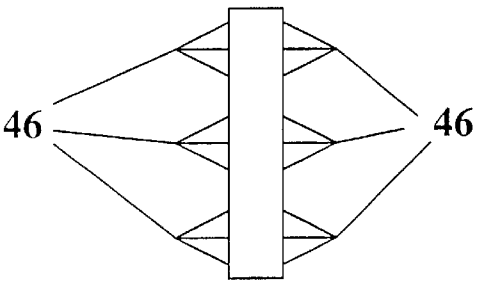
FIG. 10B is a side view of a bushing tool faceplate having striking points on two sides, in accordance with the present invention.
Figure 10C:
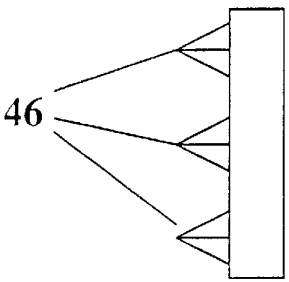
FIG. 10C is a side view of another embodiment of a bushing tool faceplate having striking points on one side, in accordance with the present invention.
Figure 11A:
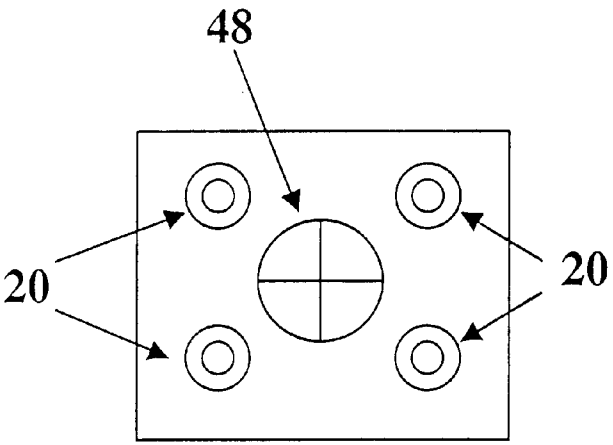
FIG. 11A is a top view of faceplate comprising a chisel point, in accordance with the present invention.
Figure 11B:
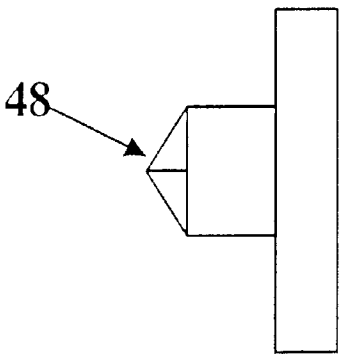
FIG. 11B is a side view of the faceplate of FIG. 11A.

Other types of faceplates are illustrated in FIGS. 10 and 11. FIGS. 10A, 10B, and 10C are a top view, a side view of one embodiment, and a side view of another embodiment, respectively, of a bushing tool faceplate, in accordance with the present invention. Bushing tools are known in the art and typically used to rough out, finish carve, and/or texture stone. As shown in FIGS. 10A, 10B, and 10C, the faceplate comprises a bushing surface having striking points 46 on one side (see FIG. 10B) or having two bushing surfaces each comprising striking points 46 (see FIG. 10C). FIGS. 11A and 11B are a top view and a side view, respectively, of faceplate comprising a chisel point 48, in accordance with the present invention. Thus, a stone hammer in accordance with the present invention may comprise faceplates having any of several types of surfaces know in the stone cutting and masonry art.

A stone hammer as described herein, provides selectable striking edges. The striking edges may be selected by rotating a faceplate, individually reversing a faceplate, striking with an opposing end of the hammer, replacing a faceplate, or any combination thereof. The need to send the hammer to be sharpened when a striking edge becomes dull is eliminated. A faceplate can be replaced relatively quickly and easily compared to the time and processing needed to refurbish the hammer as a whole. Furthermore, the need for a large inventory of stone hammers is also eliminated.

Although the stone hammer has been described in conjunction with one or more embodiments, it will be apparent to those skilled in the art that other alternatives, variations and modifications are apparent in light of the foregoing description as being within the spirit and scope of the invention. For example, the openings 20 in the faceplates need not be countersunk. Alternatively, various combinations of countersunk and non-countersunk openings are possible. In one such configuration, all the openings on one side of the faceplate are countersunk, and the opposing sides of the openings are not countersunk. The faceplates may comprise various types of material, such as metal, S7 tool steel, and other materials appropriate for the specific type of stone/material to be cut. In one exemplary embodiment, a stone hammer in accordance with the present invention comprises faceplates having S7 tool steel, hardened within a range, inclusively, between Rockwell 58 and Rockwell 60. It is not necessary for the head 16 to be hardened. Bolts 24 may comprise various types of heads, such as a slotted head, a Phillips head, an Allen head, a star shaped head, hex bolt head or combination thereof, for example. The faceplates may be attached to the head 16 of the stone hammer by means other than threaded bolts, such as clamping arrangements or the like (not shown).

In a polygonal arrangement, the faceplates are rotated by the angular increment of one or any integral number of edges. The four sided symmetrical arrangement shown is positionable at any selected 90-degree increment. It is possible to envision a similarly rectangular faceplate with two fastener holes such that the options are only two, at 180-degrees relative to one another. A polygon with a different number of sides is also possible, such as a hexagon shape with six angular increments at 60-degrees. Of course, a hexagon or the like also could be mounted so as to provide fewer mounting options than the number of faces, e.g. six or three or two, depending on the positioning of the fastener openings provided in the faceplates. The invention is intended to embrace all such alternatives, variations and modifications as may fall within the spirit and scope of the following claims.

What is claimed is:

1. A stone hammer comprising at least one faceplate having a plurality of selectable striking edges, wherein said at least one faceplate is reversible and mountable so as to present one of the striking edges at a given position on the hammer, and is detachable, rotatable and re-attachable to present a different one of the striking edges at said given position.

2. A hammer in accordance with claim 1, wherein said at least one faceplates has a rectilinear shape wherein the striking edges are defined by mutually perpendicular planes, and further comprising a weight-bearing head adapted to receive said at least one faceplates at each of two opposite ends of said head.

3. A hammer in accordance with claim 2, wherein each faceplate is attached to said head by at least one threaded fastener.

4. A hammer in accordance with claim 2, wherein said head is adapted to receive a handle.

5. A hammer in accordance with claim 4, further comprising a handle attached to said head.

6. A hammer in accordance with claim 5, wherein said handle is selected from at least one of the group consisting of a shaft, a formed fitted grip, and a handle comprising a finger guard.

7. A hammer in accordance with claim 1, wherein said at least one faceplate is shaped as a rectilinear polygon.

8. A hammer in accordance with claim 1, wherein:

said at least one faceplate defines at least one fastener opening; and each fastener opening is counterbored on opposite sides of the faceplate.

9. A hammer in accordance with claim 8, wherein:

said at least one faceplate defines four symmetrically positioned fastener openings;

said four fastener openings are symmetric about each of three orthogonal planes of said at least one faceplate; and said at least one faceplate is selectively rotatable and re-attachable at increments of 90 degrees.

10. A hammer in accordance with claim 1, wherein:

said hammer comprises two faceplates; and each faceplate comprises four selectable striking edges on each of two opposing sides of each of said faceplates, resulting in said hammer having sixteen selectable striking edges.

11. A hammer in accordance with claim 1, wherein said at least one faceplate comprises S7 tool steel.

12. A hammer in accordance with claim 1, wherein a striking edge is selected by at least one of rotating said at least one faceplate, reversing said at least one faceplate, replacing said at least one faceplate, and striking with an opposing end of said hammer.

13. A hammer in accordance with claim 12, wherein said at least one faceplate is rotated in 90 degree increments.

14. A hammer in accordance with claim 1, further comprising a detachable wedge shaped faceplate, wherein said wedge shaped faceplate and said at least one faceplate are interchangeable.

15. A hammer in accordance with claim 14, wherein a striking edge of said wedge shaped faceplate is perpendicular to a selected striking edge of said at least one faceplate.

16. A hammer in accordance with claim 1, further comprising a detachable faceplate comprising at least one of a chisel point and a bushing surface.

17. A hand held stone hammer comprising:

two detachable, replaceable, rotatable, individually reversible, rectilinear faceplates, each faceplate comprising:

four striking edges on each of a first and a second opposing side of each faceplate;

four countersink openings through said faceplate from said first to said second opposing side, each opening being countersunk on each of its opposing sides, said four openings being symmetric about each of three orthogonal planes of each faceplate;

a weight-bearing head adapted to receive a handle and adapted to receive said faceplates at opposing ends of said head, said head comprising four threaded openings on each of its opposing ends, each threaded opening positioned to align with respective ones of said countersink openings, wherein each faceplate is attached to said head by four threaded fasteners positioned within respective ones of said countersink openings and threaded into respective ones of said threaded openings, wherein:

a striking edge is selected by at least one of rotating a faceplate by 90 degree increments, reversing a faceplate, replacing a faceplate, and striking with an opposing end of said hammer.

* * * * *